US006283663B1

(12) United States Patent
Russo

(10) Patent No.: US 6,283,663 B1
(45) Date of Patent: Sep. 4, 2001

(54) PAINT APPLICATOR SYSTEM

(75) Inventor: Timothy M. Russo, 1529 Arrowhead Ave., Livermore, CA (US) 94550-6954

(73) Assignee: Timothy M. Russo, Livermore, CA (US)

( * ) Notice: Subject to any disclaimer, the term of this patent is extended or adjusted under 35 U.S.C. 154(b) by 0 days.

(21) Appl. No.: 09/568,573

(22) Filed: May 10, 2000

Related U.S. Application Data

(63) Continuation-in-part of application No. 09/450,840, filed on Nov. 29, 1999.

(51) Int. Cl.[7] ..... B43K 1/00
(52) U.S. Cl. ..... 401/260
(58) Field of Search ..... 401/258–260

(56) References Cited

U.S. PATENT DOCUMENTS 4,383,062 * 5/1983 Saad et al. ..... 524/35
4,685,820 * 8/1987 Kremer et al. ..... 401/260
5,008,328 * 4/1991 Nakai et al. ..... 524/759

* cited by examiner

*Primary Examiner*—Gregory L. Huson
*Assistant Examiner*—Peter DeVore

(57) ABSTRACT

A paint applicator system utilizing a paint reservoir which is connected to a movable nib which permits paint to pass through the reservoir to the exterior of the nib. The paint composition is placed in the reservoir and is predetermined to possess a viscosity of between 10 and 280 centipoise by the use of selective solvents.

16 Claims, 1 Drawing Sheet

Figure 2

PAINT APPLICATOR SYSTEM

CROSS-REFERENCE TO RELATED APPLICATION

The present application is a Continuation-in-Part patent application of prior filed patent application, Ser. No. 09/450,840, filed Nov. 29, 1999.

BACKGROUND OF THE INVENTION

The present invention relates to a novel and useful system for applying paint, which is particularly applicable to the repair of chips, dents, or scratches on a painted or coated surface.

Painted surfaces, including, but not limited to, those found on vehicles, are subject to the occurrence of damage. For example, damage to painted surfaces on vehicles may take the form of chips, dents, scratches, due to extraneous material contacting the vehicle, collisions with other vehicles or objects, and the like.

In the past, damaged painted surfaces have been corrected in various ways. For example, one method requires sanding an area larger than the actual area of the damage followed by painting over the sanded area, or an area larger than the sanded area. Typically, this type of repair employs elaborate automotive refinishing equipment, such as compressed air sanders, paint guns, polishers, and the like. Moreover, repairing damage to painted surfaces in this manner requires a skilled artisan and consumes a great deal of time and expense.

Another method of repairing damage to a painted surface utilizes an airbrush to fill the damaged area with paint or other colored material. The repairing material is sprayed in minuet amounts and at a low volume, by passing compressed air through the airbrush onto a small circular target. Unfortunately, the airbrush repair method does not fill chips, scratches, or dents accurately, especially if the damaged area is of an irregular configuration. Typically, material migrates to areas that are undamaged and must be removed using paint solvents or polishing materials. In addition, airbrush repairs always produce "overspray", i.e. where excess paint coats surfaces in the immediate area to the damaged painted surface. Such a method is time consuming, expensive, and may only be performed by a person of sufficient skill and training. A simpler method of repairing damage to a painted surface is to employ a container of touch-up paint and a brush, normally attached to the cap or lid of the touch-up paint container. Again, applying touch-up paint to a damaged area is difficult and results in an inconsistent repair due to drying agents, which tend to harden the paint being applied on the paintbrush before application to the surface being repaired. Normally, the repaired area is still visible after completion utilizing this method.

U.S. Pat. Nos. 4,540,303, 4,838,723, and 5,468,082 show pen nib systems for dispersing ink.

U.S. Pat. Nos. 4,812,071, 4,923,317, 5,388,925, and Des. 329,253 describe correction fluid pen devices using nibs or styluses.

U.S. Pat. Nos. 3,457,014, 3,879,141, and 5,421,664 show fluid applicators which are capable of delivering viscous fluids including water base solvents.

A system for repairing damage to painted surfaces which is easily accomplished would be a notable advance in the maintenance and repair field.

BRIEF SUMMARY OF THE INVENTION

In accordance with the present invention a novel and useful system for repairing painted surfaces is herein provided.

The system of the present invention utilizes a housing which is preferably of a size and proportion to be hand held. The housing includes a reservoir which is capable of holding a paint composition of a certain characteristic. The housing may be formed of a flexible material such that squeezing or applying pressure to the same also applies pressure to the paint composition found within the reservoir.

A nib is also found in the present invention and is slidably supported by the housing. The nib may be cylindrical, conical, spherical or any suitable shape. The nib may vary in size to determine the fineness of the paint released from the housing reservoir. The nib is located in the passageway which communicates with the reservoir. The nib is preferably constructed to confine the nib to the housing yet permit the nib to slide or float. Thus, when a force is applied to the paint composition in the reservoir either by gravity or by squeezing the housing, paint flows from the reservoir to the passageway and outwardly from the housing at the nib, which serves as a regulator of the flow rate of paint composition.

The paint composition employed in the present invention and located in the reservoir within the housing is formed of a composition that includes a pigment and a solvent. The solvent is found in combination with the pigment in sufficient amount to determine the viscosity of the paint to operatively range between 10 and 280 centipoise, measured at 22° C. In certain cases, the preferred range of viscosity of the paint composition lies between 40 and 120 centipoise. The optimal range for viscosity of the paint composition is between 63 and 95 centipoise at 22° C.

The pigment of the paint of the composition is combined with a solvent, typically a low-viscosity, organic or water based volatile liquid which is used in the present invention, to optimally set the viscosity of the paint composition for compatibility with the applicator unit. That is to say, the paint composition must flow from the reservoir, through the passageway, and to the nib for purpose of applying the paint to a body which, requiring repair of a painted surface. The organic solvents of the present invention may be selected from the group of esters and ketones consisting of ethyl acetate, isopropyl acetate, ethylene glycol n-butyl ether acetate, butyl acetate, acetone, methyl ethyl ketone, methyl isobutyl ketone, and cyclohexanone. Such ketones and esters have been found to be satisfactory as viscosity adjusting components of the paint composition of the present invention.

In addition, the solvent may be selected from the group of alcohols consisting of methanol, ethanol, isopropyl alcohol, and butyl alcohol.

Further, solvents selected from the group consisting of aromatics such as benzol (benzene), toluol (toluene), xylol (xylene), and high-flash naphtha may also satisfactorily adjust the viscosity of the paint composition of the present invention. Aliphatic solvents such as hexane, heptane, and mineral spirits may also be employed alone or blended with such aromatics to adjust the viscosity of the paint composition herein described.

Moreover, glycol ethers such as ethylene glycol ethyl ether (Cellosolve), and ethylene glycol n-butyl ether (Butyl Cellosolve) may also be employed as a solvent.

Where the paint composition is water-based, water or water containing liquids may be employed as a solvent for the same.

The pigment of the paint composition may be of any type sufficient to provide a coating property for repair of damage to a painted surface. That is to say, the pigments may provide a decorative function to contribute opacity, color, and gloss control. In addition, pigments also provide protective qualities to the final paint composition after it has hardened. In this regard, pigments may of any class, including white hiding pigments, extender pigments, black pigments, and any other color pigments known in the art. In addition, metallic pigments may be used based on metals such as aluminum, bronze, zinc, and lead.

It may be apparent that a novel and useful paint application system for preparing a painted body has been described.

It is therefore an object of the present invention to provide a paint applicator system which is simple to use and which successfully effects repairs of damage to painted surfaces such as chips, scratches, and dents.

Another object of the present invention is to provide a paint applicator system which may be performed by a person who is not highly trained in the art of paint repairing methods and techniques.

A further object of the present invention is to provide a paint application system which eliminates expensive equipment, and may be performed in a time period which is substantially less than the time required using techniques and system of the prior art.

Another object of the present invention is to provide a paint applicator system which eliminates inaccuracies in applying paints, characteristic of the systems of the prior art.

Yet another object of the present invention is to provide a paint application system in which a paint composition may be stored in an applicator unit for a long period of time, since drying agents are not used in the paint composition of the present invention.

Another object of the present invention is to provide a paint applicator system in which drying agents are not used and where the composition is stored in a sealed container, thus, preventing evaporation of paint solvents and premature curing of the paint composition during application.

The invention possesses other objects and advantages especially as concerns particular characteristics and features thereof which will become apparent as the specification continues.

Figures 1, 2, 3:
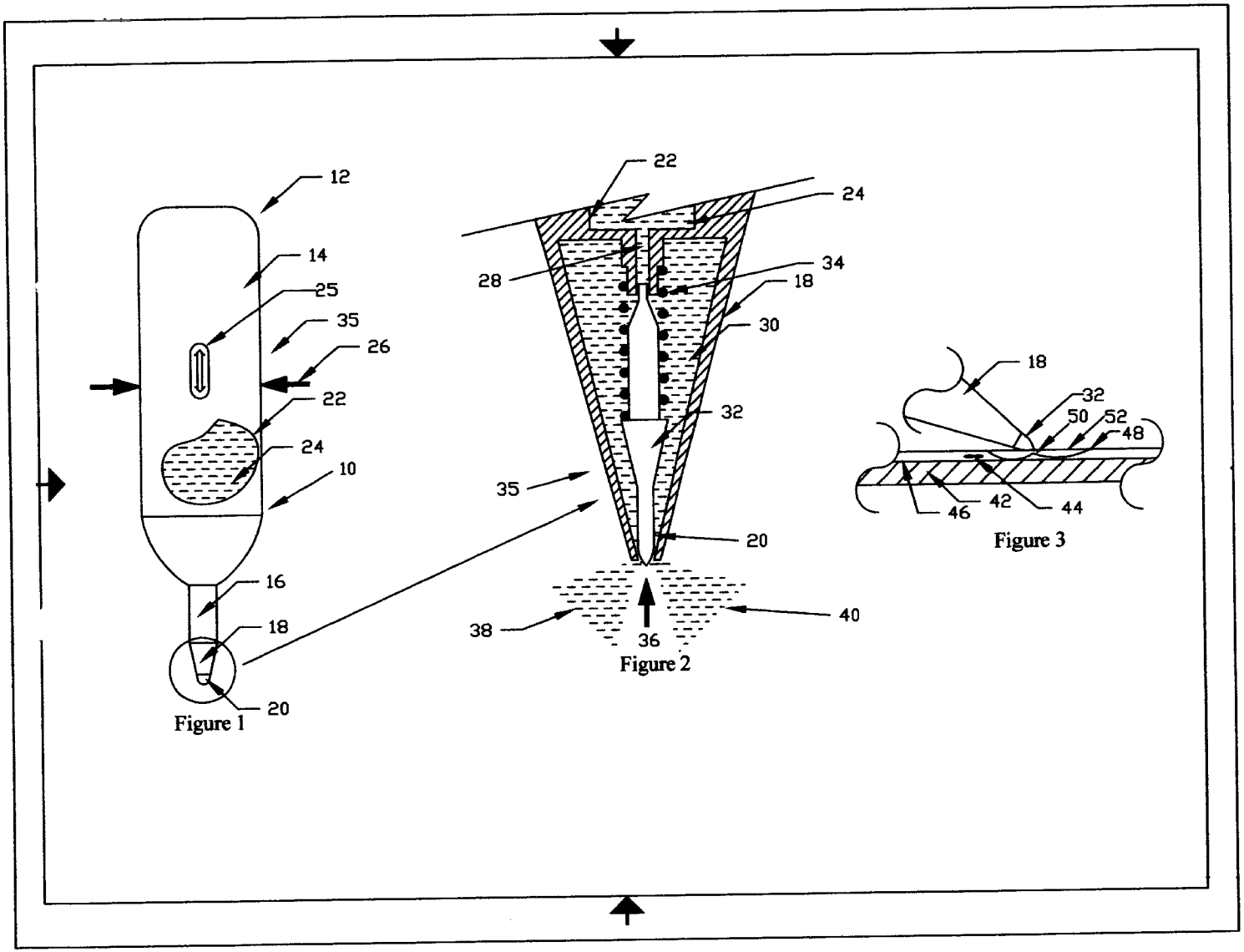
FIG. 1 is a top view of the applicator employed with the paint composition of the present invention with a broken away portion depicting the paint reservoir.
FIG. 2 is a sectional view showing a typical nib and passageway arrangement for the applicator of the present invention.
FIG. 3 is a sectional view depicting the use of the applicator of the present invention on a damaged area to a paint surface.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which may be understood by reference to the drawings hereinabove described.

The invention as a whole is shown in the drawings by reference character 10. The system 10 of the present invention includes a housing 12 which may include a tubular body having a restricted portion 16 at one end thereof. Restricted portion 16 further includes a funnel or conical end portion 18 which terminates in an opening 20. Housing 12 includes an interior reservoir 22 for holding a paint composition 24, the nature of which will be described in greater detail hereinafter. Mixing weight 25 lies within reservoir 22. As is depicted in FIG. 1, tubular portion or element 14 of housing 12 may be formed of a flexible or resilient material and is capable of being squeezed, per force arrows 26. Such applied force would deform tubular element 14 and tend to force paint composition 24 through opening 20, the details of which will be discussed hereinafter.

Turning to FIG. 2, it may be observed that a typical conical section 18 of housing 12 is depicted. A passageway 28 is included which permits the paint composition 24 to flow from reservoir 22 to chamber 30, and to a nib or stylus 32 is slidable within chamber 30 and biased downwardly by spring 34 into such a position, nib 32 tends to seal opening 20 to chamber 30. However, when an upward force is applied to the tip of nib 32, force arrow 36, nib slides upwardly and allows paint composition 24 to flow from reservoir 22, through passageway 28 and chamber 30 and outwardly from housing 18, arrows 38 and 40. An applicator unit 35 may be deemed to be formed from housing 12, reservoir 22, passageway 28, and nib 32.

FIG. 3 represents a body 42 having a paint layer 44 terminating in a smooth surface 46. Surface 46 would be typical of a finish on a vehicle. A chip 48 was filled with paint dose 50 such that the surface 52 of paint dose 50 was initially slightly higher than the level of surface 46 of end surface 44. FIG. 3 represent the final paint repair after solvents have evaporated in which surface 52 is level with surface 46.

Paint composition 24 includes a pigment and a sufficient amount of solvent to fix or determine viscosity of paint composition 24. With sliding nib 32, the determination of viscosity is critical. For example, if the viscosity of paint composition 24 is too great, the paint composition 24 from reservoir 22 will not flow into areas to be repaired such as paint chip 48. On the other hand, a paint viscosity which is too little will cause paint composition will flow too quickly from nib 32 to overflow damaged area such as chip 48. When chip 48 is small, this problem is amplified. In addition, the use of driers or commercially available paints cause clogging of passageway 28 or opening 20. Thus, driers, typically used in paints, hinder the free flow of paint from applicator 35. In addition, paint containing driers and/or fast evaporating solvents, cured too quickly on the surface being repaired, causing a non-uniform repair.

Paint composition 24 has been determined to operate properly by the addition of a solvent in order to adjust the viscosity of composition 24. For example, the operative range of the viscosity of paint composition 24 ranges between 10 and 280 centipoise. A preferred range of viscosity for paint composition 24 is 40 to 120 centipoise. An optimal range for viscosity lies between 63 and 95 centipoise. All viscosities are measured at 22° C. In this regard, viscosity may be measured by any known apparatus. Typically, viscosity is measured by a viscosity cup having an orifice of a certain size. For example, cups under the designation of Dupont, Perlin, Fisher, Ford, Saybolt Universal, Zahn, Sears Craftsmen, and the like may be employed. Zahn cups were employed in the present application.

Organic solvents for oil-based paint compositions which have found to be satisfactory in this regard may be selected from a group consisting of ethyl acetate, isopropyl acetate, ethylene glycol n-butyl ether acetate, ethylene glycol ethyl ether, ethylene glycol n-butyl ether, ethyl ether acetate, butyl acetate, acetone, methyl ethyl ketone, methyl isobutyl ketone, and cyclohexanone. Aside from such ketones and esters, alcohols such as methanol, ethanol, butyl alcohol, isopropyl alcohol and carbitol have also been found to work as a solvent in the system of the present invention. Moreover, benzol (benzene), toluol (toluene), xylol (xylene), and high-flash naphtha, alone or combined with hexane, heptane and mineral spirits, may also be used to adjust the viscosity of paint composition 24 to the proper level.

In addition, glycol ethers such as ethylene glycol ethyl ether (Cellosolve), and ethylene glycol n-butyl ether (Butyl Cellosolve) may also be employed as a solvent).

Where the paint composition is water-based, water or water containing liquid may be employed as a solvent for the same.

Paint composition 24 also includes pigment, which may be of any type. Metallic pigments utilizing aluminum, bronze, zinc, or lead have been found to be satisfactory.

The following examples are intended to represent and illuminate the invention sought for patenting, but is not deemed to restrict the scope of the invention in any manner.

EXAMPLE 1

A black acrylic lacquer paint was used in conjunction with an applicator known as the Pentel pocket correction pen. The correction fluid in the pen was emptied and refilled with touch-up paint commercially available. The paint was a black pigment paint and was employed to repair a chip on a Toyota automobile, whose painted surface had been damaged. The lacquer did not flow properly from the applicator, causing a lumping of the repair surface. The repair was deemed not to be acceptable.

Further adjustments were made by the use of the addition of methyl ethyl ketone solvent. Although the paint and solvent flowed nicely from the applicator, the repair of a scratch on the same Toyota automobile was unacceptable since paint composition from the reservoir of the applicator flowed in too large an amount. The finished repair also took on a transparent look and was considered not to be a good paint match.

EXAMPLE 2

The same applicator as is used in Example 1 was filled with a paint composition in which the viscosity of black lacquer paint was adjusted to between 40 and 120 centipoise by the use of methyl ethyl ketone solvent. Viscosity was measured using a DuPont M-50 viscosity cup at 22° C. The repair took place on a black Toyota. After letting the touch-up paint composition dry for 30 minutes, a good appearance was found.

The same repair was repeated by adjusting the viscosity of the paint composition using the same solvent to 63 to 95 centipoise. Appearance was considered to be superior when the paint dried.

Finally, the paint composition was adjusted to the extremes of 10 to 280 centipoise, acceptable repairs were found to have occurred at the extremes of this range.

EXAMPLE 3

The applicator used in Examples 1 and 2 was employed again to repair a metallic green and beige paint on Toyota automobiles that had been damaged by scratches and chips. The viscosity of the metallic paint was adjusted as described in Example 2 and applied to this automobile. After 30 minutes of drying, it was determined that the repairs were satisfactory.

While in the foregoing, embodiments and examples of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A paint applicator system for repairing a painted body, comprising:

a. a housing including a passageway;

b. a reservoir located in said housing, said passageway communicating with said reservoir;

c. a nib supported by said housing, said nib located in said passageway communicating with said reservoir, said nib including a portion extending from said passageway, said housing, reservoir, and nib comprising an applicator unit; and d. a paint composition, said composition including a pigment and a sufficient amount of solvent to determine the viscosity of said paint between 10 and 280 centipoise, measured at 22° C., said paint composition positioned in said reservoir to allow flow of said paint through said passageway, to said nib, said paint at said nib intended to be transferred to the body.

2. The paint application system of claim 1 in which said paint composition possesses a viscosity of between 40 and 120 centipoise at 22° C.

3. The paint application system of claim 1 in which said paint composition possesses a viscosity of between 63 and 95 centipoise at 22° C.

4. The system of claim 1 in which said solvent is selected from the group consisting of ethyl acetate, isopropyl acetate, butyl acetate, ethylene glycol ethyl ether, ethylene glycol n-butyl ether acetate, acetone, methyl ethyl ketone, methyl isobutyl ketone, and cyclohexanone.

5. The system of claim 1 in which said solvent is selected from the group consisting of methanol, ethanol, butyl alcohol, isopropyl alcohol and carbitol.

6. The system of claim 1 in which said solvent is selected from the group consisting of benzol, toluol, xylol and High-flash naphtha.

7. The system of claim 1 in which said pigment comprises a metallic pigment including a metallic component.

8. The system of claim 7 in which said metallic component of said metallic pigment is selected from the group consisting of:

aluminum, bronze, zinc, and lead.

9. The system of claim 7 in which said solvent is selected from the group consisting of ethyl acetate, isopropyl acetate, butyl acetate, ethylene glycol ethyl ether acetate, acetone, methyl ethyl ketone, methyl isobutyl ketone, and cyclohexanone.

10. The system of claim 7 in which said solvent is selected from the group consisting of methanol, ethanol, butyl alcohol, isopropyl alcohol, and carbitol.

11. The system of claim 7 in which said solvent is selected from the group consisting of benzol, toluol, xylol and high-flash naphtha.

12. The system of claim 7 in which said solvent is water.

13. The system of claim 7 in which said solvent is selected from the group consisting of hexane, heptane, and mineral spirits.

14. The system of claim 7 in which said solvent is selected from the group consisting of ethyl acetate, isopropyl acetate, butyl acetate, ethylene glycol ethyl ether, ethylene glycol n-butyl ether acetate, acetone, methyl ethyl ketone, methyl isobutyl ketone, and cyclohexanone.

15. The system of claim 1 in which said solvent is water.

16. The system of claim 1 in which said solvent is selected from the group consisting of hexane, heptane, and mineral spirits.

* * * * *